US007032546B2

(12) United States Patent
Kaya et al.

(10) Patent No.: US 7,032,546 B2
(45) Date of Patent: Apr. 25, 2006

(54) COOLANT PUMPS WITH COUPLING MEANS

(75) Inventors: Yasar Kaya, Esslingen (DE); Willi Weber, Mainhardt (DE); Martin Zeilinger, Ostfildern (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/062,307

(22) Filed: Feb. 15, 2005

(65) Prior Publication Data

US 2005/0188927 A1 Sep. 1, 2005

Related U.S. Application Data

(63) Continuation-in-part of application No. PCT/EP03/08678, filed on Aug. 6, 2003.

(30) Foreign Application Priority Data

Aug. 17, 2002 (DE) ..... 102 37 778

(51) Int. Cl.
*F01P 5/10* (2006.01)

(52) U.S. Cl. ..... 123/41.44

(58) Field of Classification Search ..... 123/41.44, 123/198 C; 417/2, 5, 62, 106, 216, 426
See application file for complete search history.

(56) References Cited

U.S. PATENT DOCUMENTS

2002/0083905 A1 7/2002 Kim

FOREIGN PATENT DOCUMENTS

| | | |
|---|---|---|
| DE | 1 042 968 | 11/1958 |
| DE | 30 07 640 | 9/1981 |
| FR | 82 00182 | 7/1983 |
| FR | 2 752 016 | 2/1996 |
| JP | 62 153596 | 7/1987 |
| JP | 01 262315 | 10/1989 |

*Primary Examiner*—Noah P. Kamen
*Assistant Examiner*—Katrina Harris
(74) *Attorney, Agent, or Firm*—Klaus J. Bach

(57) ABSTRACT

In a coolant pump arrangement in a cooling circuit of an internal combustion engine, including a first coolant pump having a drive mounted on a pump shaft at one side of the first coolant pump, a second coolant pump is connected to the pump shaft at the other side of the first coolant pump via a transmission arrangement including a clutch and a speed change drive for controlling operation of the second coolant pump relative to the first coolant pump.

12 Claims, 1 Drawing Sheet

COOLANT PUMPS WITH COUPLING MEANS

This is a Continuation-In-Part Application of International Application PCT/EP03/08678 filed Aug. 6, 2003 and claiming the priority of German Application 102 37 778.2 filed Aug. 17, 2002.

BACKGROUND OF THE INVENTION

The invention relates to coolant pumps in a cooling circuit of an internal combustion engine including a first coolant pump driven by the internal combustion engine and a second coolant pump which can be coupled to the first coolant pump by a clutch.

DOS 1 476 365 discloses a coolant pump with two co-axial impeller wheels. The first impeller wheel is firmly mounted onto a drive shaft whereas the second impeller wheel can be connected to first impeller wheel by a pressure-controlled clutch wherein the control pressure for the clutch depends on the temperature of the liquid being pumped.

It is the object of the present invention to provide a coolant pump arrangement by which optimal cooling of the engine and small power consumption is ensured.

SUMMARY OF THE INVENTION

In a coolant pump arrangement in a cooling circuit of an internal combustion engine, including a first coolant pump having a drive wheel mounted on a pump shaft at one side of the first coolant pump, a second coolant pump is connected to the pump shaft at the other side of the first coolant pump via a transmission arrangement including a clutch and a speed change drive for controlling operation of the second coolant pump relative to the first coolant pump.

With this arrangement, the cooling performance of the second coolant pump can be controlled independently of the speed of the internal combustion engine. Depending on the transmission ratio of the pump drive, the second coolant pump may be very small.

In this connection, it is advantageous if the first and second coolant pumps can be interconnected by the clutch and/or the drive in a form- and/or force-locking manner. With the use of a form-locking connection, power transfer losses are avoided.

In accordance with a particular embodiment of the invention, the first coolant pump and the second coolant pump are arranged in a common housing. This provides not only for an efficient space utilization but permits pre-assembly and concurrent testing.

It is further advantageous if the transmission ratio i of the pump drive is between 0.05 and 0.9, particularly between 0.2 and 0.5. The speed of the second coolant pump can therefore be selected depending on its size and the required pumping power or, respectively, the cooling requirements.

In addition, an advantageous operating point in the intersection of the characteristic engine performance line and the characteristic pump performance line can be obtained.

It is also advantageous if the second coolant pump comprises a suction line and a pressure line with a check valve arranged in the suction line. If the first coolant pump has a higher pumping volume the coolant cannot flow back from the pressure line of the first coolant pump by way of the second coolant pump to the coolant admission line.

In accordance with a preferred embodiment, the first coolant pump is connected to the internal combustion engine to be driven thereby or to a separate motor in a form- and/or force-locking manner. The separate motor may be an electric motor or a pneumatic drive.

It is particularly important in connection with the invention that the ratio of the specific pumping volume of the first coolant pump and the second coolant pump is between 1.5 and 10, particularly between 2 and 6.

Preferably, the clutch includes an automatic or manually operable control device and the transmission ratio i of the coupling drive can be automatically or manually be changed wherein the coupling drive includes a control element which senses the temperature of the coolant in the coolant circuit by means of a temperature sensor. The speed of the pump, or respectively, the pumping volume thereof may be automatically controlled by the control unit which takes at least the coolant temperature and possibly other parameters of the internal combustion engine, such as engine speed, into consideration.

Further advantages and features of the invention will become more readily apparent from the following description thereof on the basis of the accompanying drawings.

DESCRIPTION OF A PREFERRED EMBODIMENTS

Figure 1:
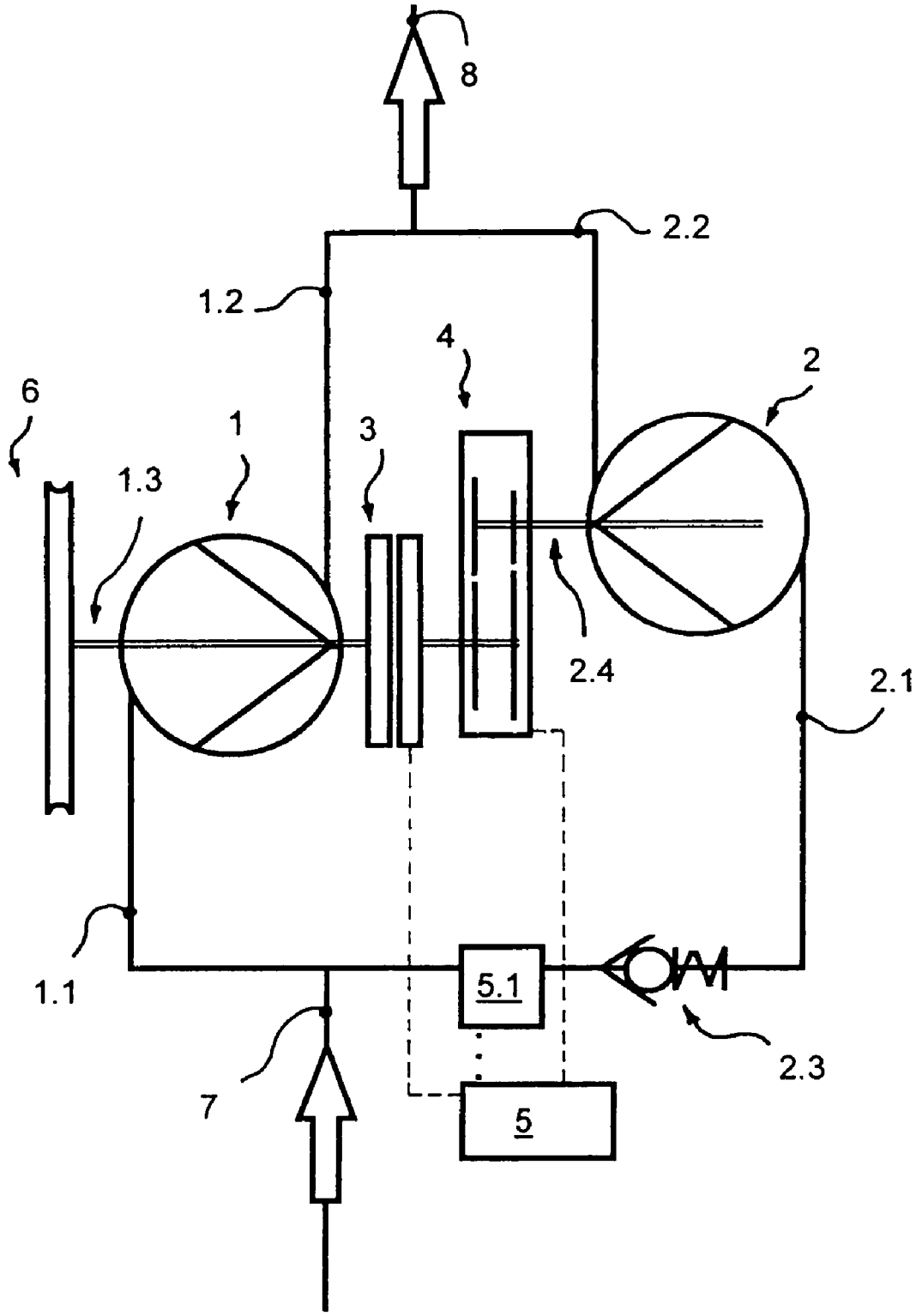
FIG. 1 shows schematically a first and a second coolant pump interconnected by a clutch and a power transmission.

FIG. 1 shows a coolant pump 1 having a shaft 1.3 with a belt pulley 6 by way of which the pump 1 is driven. At the side of the pump 1 opposite the belt pulley 6, the pump shaft 1.3 is connected to a clutch 3. The clutch 3 is associated with a speed change drive 4 which converts the speed of the first coolant pump 1 to a higher speed. The speed change drive is an infinitely variable transmission with a transmission ratio i variable between 0.2 and 0.8. The speed change drive 4 is connected to a second coolant pump 2, that is, to the pump shaft 2.4 of the second coolant pump 2 for driving the second coolant pump at a variable speed relative to the first coolant pump.

Coolant is supplied to the coolant pump 1.2 by way of a coolant supply line 7, which branches into individual suction lines 1.1, 2.1 leading to the first and second pumps 1, 2. Via the pressure line 1.2 and the pressure line 2.2, the coolant is conducted from the pumps to a common coolant supply line 8 and to the internal combustion engine which is not shown.

Within the suction line 2.1 of the second coolant pump 2, a check valve 2.3 is arranged. The check valve 2.3 however may also be arranged in the pressure line 2.2 of the second coolant pump 2.

A control unit 5 controls the transmission ratio of the infinitely variable transmission 4 depending on the coolant temperature signal supplied by a temperature sensor 5.1 arranged in the suction line 2.1

What is claimed is:

1. A coolant pump arrangement in a cooling circuit of an internal combustion engine comprising a first coolant pump (1) having a pump shaft (1.3) with a drive pulley (6), a second coolant pump (2) operatively connected to the pump shaft (1.3) of the first pump (1) at the side thereof opposite the drive pulley (6) via a transmission arrangement including a clutch (3), and a speed change drive (4) for controlling operation of the second coolant pump (2) relative to the first coolant pump (1).

2. A coolant pump arrangement according to claim 1, wherein the first coolant pump (1) and the second coolant pump (2) are interconnected by the clutch (3) and the speed change drive (4) in one of a form- and force-locking manner.

3. A coolant pump arrangement according to claim 1, wherein the first and the second coolant pumps (1, 2) are arranged in a common housing.

4. A coolant pump arrangement according to claim 1, wherein the speed change drive (4) is an infinitely variable transmission with a transmission ratio variable between 0.05 and 0.9.

5. A coolant pump arrangement according to claim 4, wherein the transmission ratio is variable between 0.2 and 0.5.

6. A coolant pump arrangement according to claim 1, wherein the second coolant pump (2) includes a suction line (2.1) and a pressure line (2.2) and a check valve (2.3) is arranged in one of the suction line (2.1) and the pressure line (2.2).

7. A coolant pump arrangement according to claim 1, wherein the first coolant pump (1) is connected to the internal combustion engine in one of a form- and force-locking manner.

8. A coolant pump arrangement according to claim 1, wherein the first coolant pump (1) has a specific pump volume relative to the second coolant pump (2) of between 1.5 and 10.

9. A coolant pump arrangement according to claim 8, wherein the first coolant pump (1) has a specific pump volume relative to the second coolant pump (2) of between 2 and 6.

10. A coolant pump arrangement according to claim 1, wherein a control unit (5) is provided for automatically or manually controlling the clutch (3).

11. A coolant pump arrangement according to claim 4, wherein a control unit (5) is provided for automatically or manually controlling the transmission ratio of the infinitely variable transmission (4).

12. A coolant pump arrangement according to claim 1, wherein a temperature sensor (5.1) is arranged in the coolant line (2.1) and connected to a control unit (5) for controlling the operation of the clutch (3) and the speed change drive (4).

* * * * *